US005823915A

United States Patent [19]

Chen

[11] Patent Number: 5,823,915

[45] Date of Patent: Oct. 20, 1998

[54] EXERCISE BICYCLE

[76] Inventor: Ping Chen, No. 29, Nanmei St., Nantun Li, Nantun Dist, Taichung, Taiwan

[21] Appl. No.: 939,733

[22] Filed: Oct. 6, 1997

[51] Int. Cl.[6] ..... A63B 21/00; A63B 69/16

[52] U.S. Cl. ..... 482/57; 482/908

[58] Field of Search ..... 482/57, 58, 59, 482/62, 72, 51

[56] References Cited

U.S. PATENT DOCUMENTS

| | | | |
|---|---|---|---|
| 4,084,810 | 4/1978 | Forsman | 482/57 |
| 4,577,860 | 3/1986 | Matias | 482/57 |
| 5,160,305 | 11/1992 | Lin | 482/57 |
| 5,338,272 | 8/1994 | Sureney | 482/57 |
| 5,356,356 | 10/1994 | Hildebrandt et al. | 482/62 |
| 5,601,515 | 2/1997 | Matsumoto | 482/57 |

*Primary Examiner*—Stephen R. Crow
*Attorney, Agent, or Firm*—Welsh & Katz, Ltd.

[57] ABSTRACT

An exercise bicycle includes a supporting base having a first portion and a second portion, a hood fixedly mounted on the first portion of the supporting base, a first positioning beam fixedly mounted on the hood, a first adjusting beam adjustably mounted on the first positioning beam, a handle fixedly mounted on an upper end portion of the first adjusting beam, a second positioning beam fixedly mounted on the second portion of the supporting base, a second adjusting beam adjustably mounted on the second positioning beam, a third adjusting beam adjustably mounted on the second adjusting beam, and a seat fixedly mounted on an upper end portion of the third adjusting beam

7 Claims, 4 Drawing Sheets

EXERCISE BICYCLE

FIELD OF THE INVENTION

The present invention relates to an exercise bicycle.

BACKGROUND OF THE INVENTION

Sometimes, our exercise activities are restricted to being performed indoors due to the heavy traffic or bad weather, therefore, it is necessary to provide an exerciser which can be employed indoors for exercise purposes.

The present invention has arisen to solve the above-mentioned problem.

SUMMARY OF THE INVENTION

In accordance with one aspect of the present invention, there is provided an exercise bicycle comprising a supporting base including a first portion and a second portion, a hood fixedly mounted on the first portion of the supporting base, a first positioning beam fixedly mounted on the hood, a first adjusting beam adjustably mounted on the first positioning beam, a handle fixedly mounted on an upper end portion of the first adjusting beam, a second positioning beam fixedly mounted on the second portion of the supporting base, a second adjusting beam adjustably mounted on the second positioning beam, a third adjusting beam adjustably mounted on the second adjusting beam, and a seat fixedly mounted on an upper end portion of the third adjusting beam.

Further features of the present invention will become apparent from a careful reading of the detailed description with appropriate reference to the accompanying drawings.

DETAILED DESCRIPTION OF THE PREFERRED EMBODIMENTS

Figure 1:
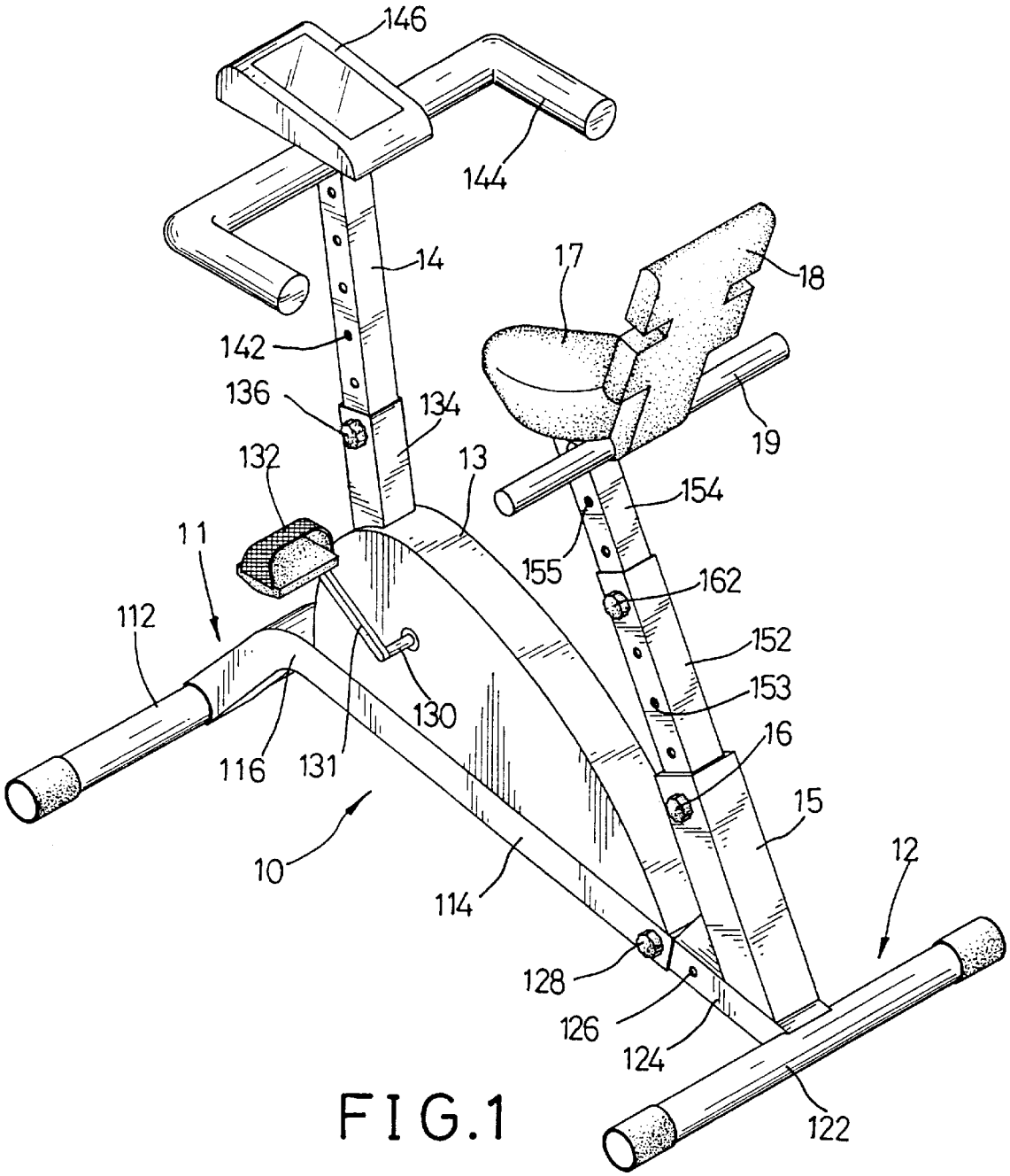
FIG. 1 is a perspective view of an exercise bicycle in accordance with the present invention.
Figure 2:
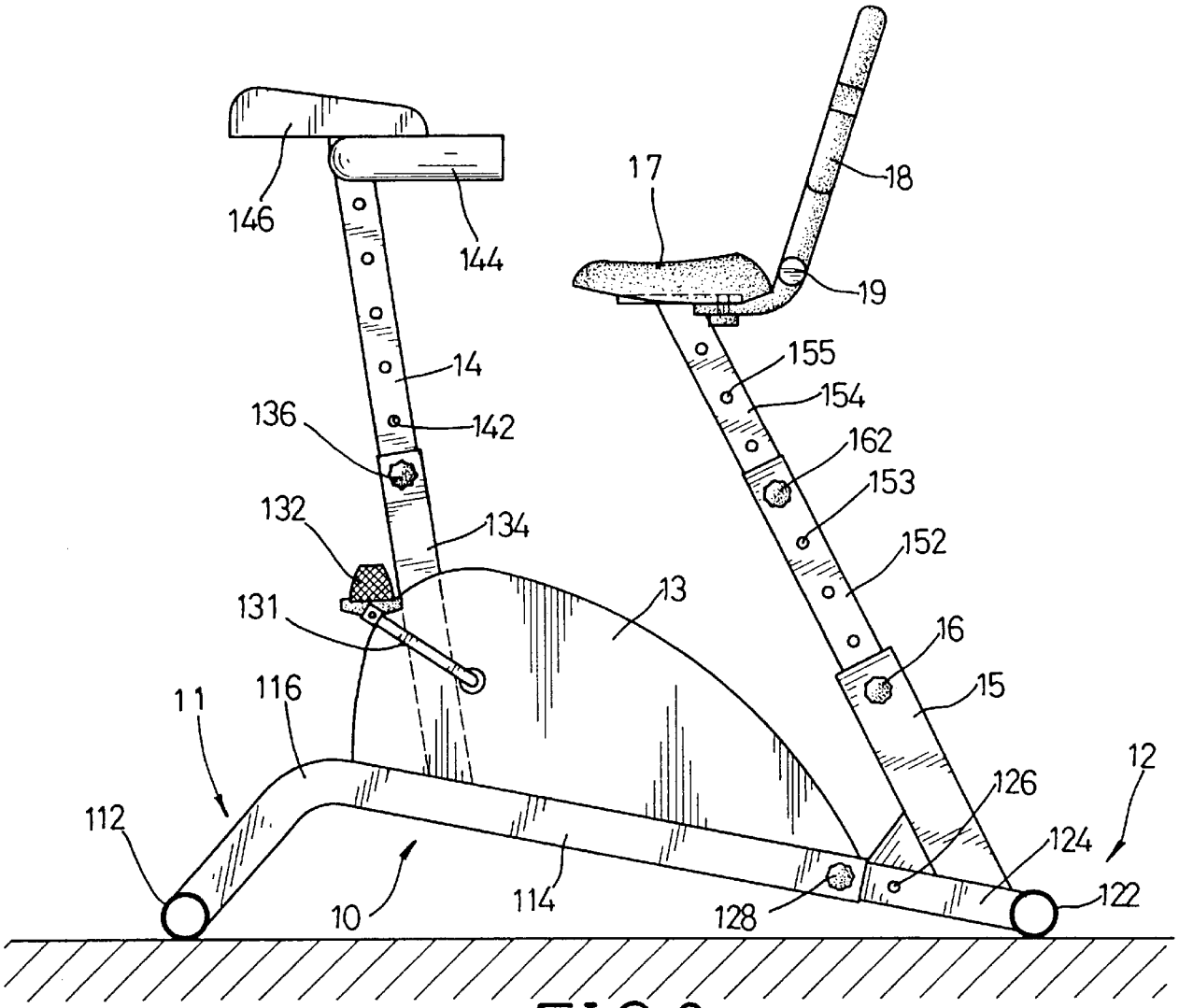
FIG. 2 is a side plan view of the exercise bicycle as shown in FIG. 1.

Referring to the drawings, and initially to FIGS. 1 and 2, an exercise bicycle according to the present invention comprises a supporting base 10 comprising a substantially T-shaped first body 11 including a first supporting rod 112 horizontally disposed and a first supporting beam 114 having a first end portion fixedly mounted on a mediate portion of the first supporting rod 112 and a second end portion, and a substantially T-shaped second body 12 including a second supporting rod 122 horizontally disposed and a second supporting beam 124 having a first end portion fixedly mounted on a mediate portion of the second supporting rod 122 and a second end portion adjustably mounted on the second end portion of the first supporting beam 114.

The first end portion of the first supporting beam 114 preferably includes a bent portion 116.

The second supporting beam 124 defines a plurality of adjusting holes 126 (only one adjusting hole 126 is shown) therein, and a retaining member 128 extends through the first supporting beam 114 and through one of the plurality of adjusting holes 126 such that the second supporting beam 124 can be adjustably mounted on the first supporting beam 114.

A hood 13 is fixedly mounted on the first supporting beam 114. A drive shaft 130 is rotatably mounted in the hood 13 and includes two distal ends each fixedly connected with a first end of a crank 131 whose second end is pivotally connected with a pedal 132. A tension adjusting mechanism (not shown) is mounted in the hood 13 and is engaged with the drive shaft 130 for damping a rotation of the drive shaft 130.

A first adjusting beam 14 is adjustably mounted on a first positioning beam 134 which is fixedly mounted on the hood 13. A handle 144 is fixedly mounted on an upper end portion of the first adjusting beam 14, and an instrument panel 146 is rotatably mounted on the handle 144.

The first adjusting beam 14 defines a plurality of adjusting holes 142 therein, and a retaining member 136 extends through the first positioning beam 134 and through one of the plurality of adjusting holes 142 such that the first adjusting beam 14 can be adjustably mounted on the first positioning beam 134.

A second positioning beam 15 is fixedly mounted on the second supporting beam 124 in an inclined manner, and a second adjusting beam 152 is adjustably mounted on the second positioning beam 15.

The second adjusting beam 152 defines a plurality of adjusting holes 153 therein, and a retaining member 16 extends through the second positioning beam 15 and through one of the plurality of adjusting holes 153 such that the second adjusting beam 152 can be adjustably mounted on the second positioning beam 15.

A third adjusting beam 154 is adjustably mounted on the second adjusting beam 152 and defines a plurality of adjusting holes 155 therein, and a retaining member 162 extends through the second adjusting beam 152 and through one of the plurality of adjusting holes 155 such that the third adjusting beam 154 can be adjustably mounted on the second adjusting beam 152.

A seat 17 is fixedly mounted on an upper end portion of the third adjusting beam 154, a backrest 18 is fixedly mounted on one end portion of the seat 17, and an auxiliary handle 19 is fixedly mounted on a lower end portion of the backrest 18.

Figure 3:
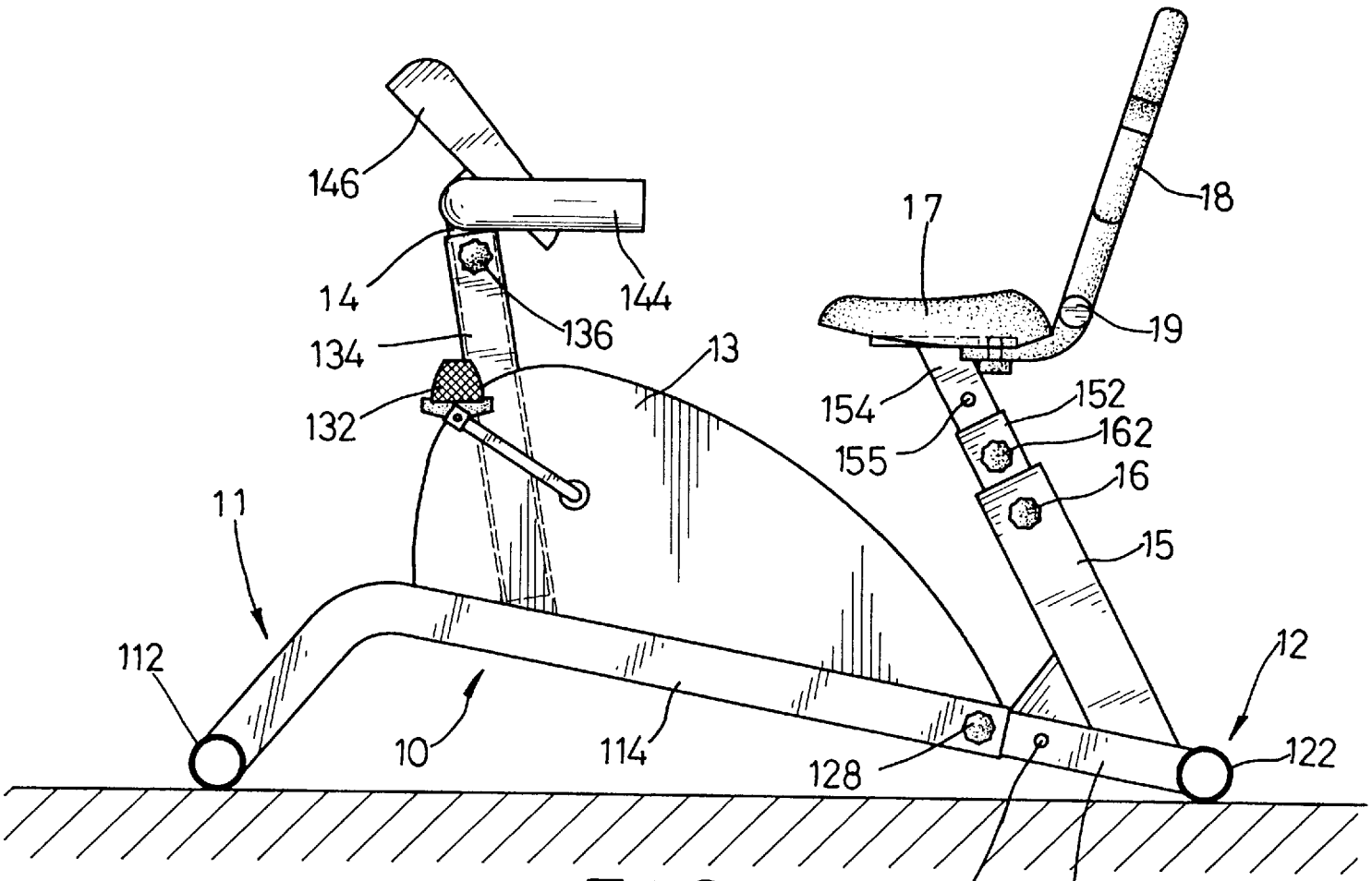
FIGS. 3 and 4 are operational views of FIG. 2.

Referring to FIG. 3, the first adjusting beam 14 can be retracted into the first positioning beam 134 and the hood 13, thereby lowering the handle 144.

In addition, the third adjusting beam 154 can be retracted into the second adjusting beam 152 which can be in turn retracted into the second positioning beam 15, thereby lowering the seat 17.

Figure 4:
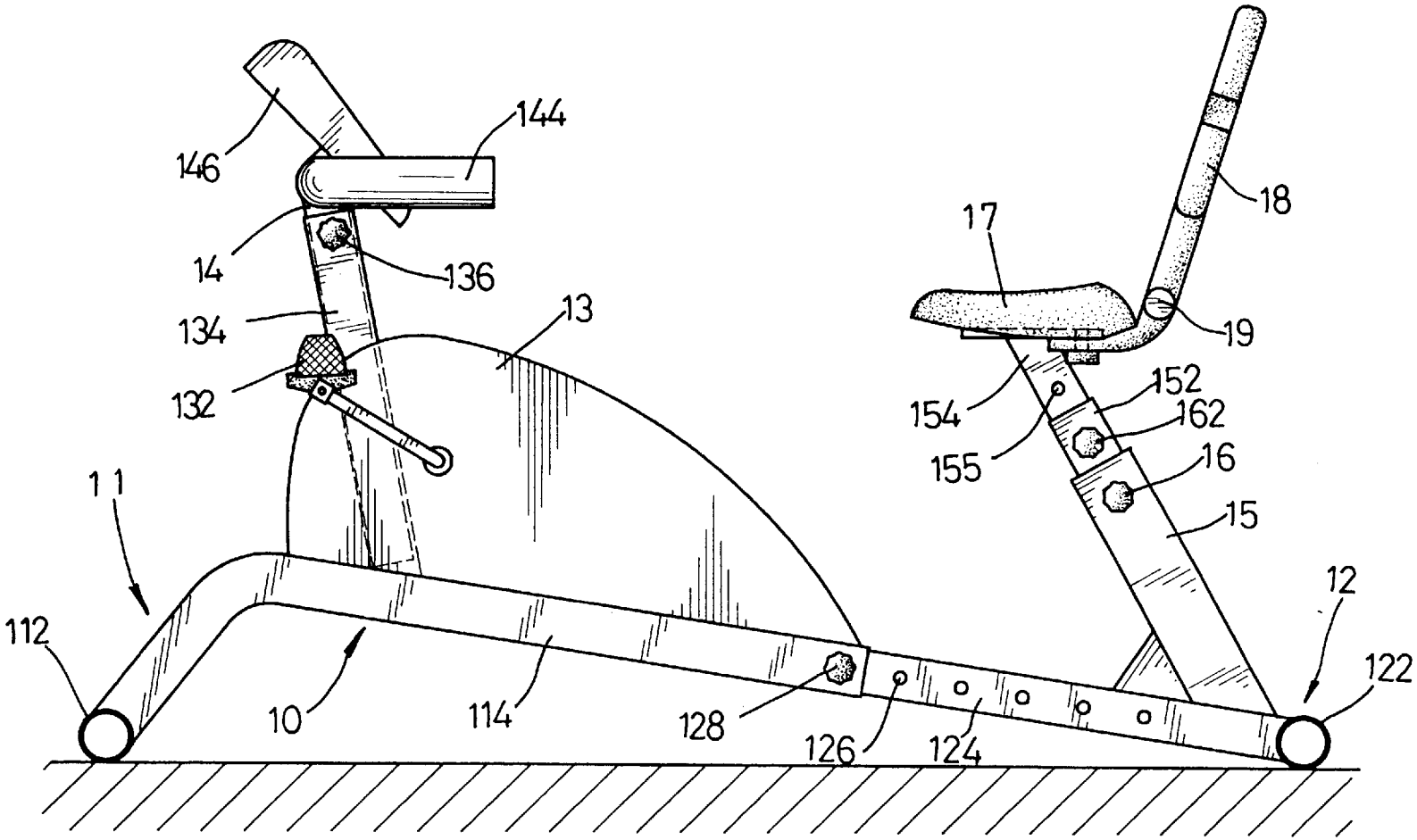

Referring to FIG. 4, the distance between the handle 144 and the seat 17 can be lengthened by adjusting the relative position between the first supporting beam 114 and the second supporting beam 124.

By such an arrangement, the height of the handle 144 and the seat 17 and the relative location between the handle 144 and the seat can be arbitrarily adjusted so as to suit a user of different statures, thereby facilitating the user exercising his/her body.

It is to be noted that, in the situation as shown in FIG. 4, the user can place his/her hands on the auxiliary handle 19 during exercising process.

It should be clear to those skilled in the art that further embodiments may be made without departing from the scope and spirit of the present invention.

What is claimed is:

1. A exercise bicycle comprising:

a supporting base including a substantially T-shaped first body including a first supporting rod horizontally disposed and a first supporting beam having a first end portion fixedly mounted on a mediate portion of said first supporting rod and a second end portion, and a substantially T-shaped second body including a second supporting rod horizontally disposed and a second supporting beam having a first end portion fixedly mounted on a mediate portion of said second supporting rod and a second end portion adjustable mounted on said second end portion of said first supporting beam, said second supporting beam defining a plurality of adjusting holes therein:

a retaining member extending thorough said first supporting beam and through one of said plurality of adjusting holes such that said second supporting beam can be adjustabley mounted on said first supporting beam:

a hood fixedly mounted on said first supporting beam of said supporting base;

a first positioning beam fixedly mounted on said hood;

a first adjusting beam adjustabley mounted on said first positioning beam;

a handle fixedly mounted on an upper end portion of said first adjusting beam;

a second positioning beam fixedly mounted on said second supporting beam of said supporting base;

a second adjusting beam adjustabley mounted on said second positioning beam;

a third adjusting beam adjustabley mounted on said second adjusting beam;

a seat fixedly mounted on an upper end portion of said third adjusting beam;

pedal means movable mounted on said hood; and resistance means mounted in said hood for providing resistance to movement of said pedal means.

2. The exercise bicycle in accordance with claim 1, wherein said first adjusting beam defines a plurality of second adjusting holes therein, and a second retaining member extends through said first portioning beam and though one of said plurality of second adjusting holes such that said first adjusting beam can be adjustabley mounted on said first positioning beam.

3. The exercise bicycle in accordance with claim 1, wherein said second adjusting beam defines a plurality of second adjusting holes therein, and a second retaining member extends through said second positioning beam and through one of said plurality of second adjusting holes such that said second adjusting beam can be adjustabley mounted on said second positioning beam.

4. The exercise bicycle in accordance with claim 1, wherein said third adjusting beam defines a plurality of second adjusting holes therein, and a second retaining member extends though said second adjusting beam and though one of said plurality of second adjusting holes such that said third adjusting beam can be adjustabley mounted on said second adjusting beam.

5. The exercise bicycle in accordance with claim 1, further comprising a backrest fixedly mounted on one end portion of said seat.

6. The exercise bicycle in accordance with claim 5, further comprising an auxiliary handle fixedly mounted on a lower end portion of said backrest.

7. The exercise bicycle in accordance with claim 1, wherein said first end portion of said first supporting beam includes a bent portion.

* * * * *